United States Patent [19]

Iyer

[11] 3,994,579

[45] Nov. 30, 1976

[54] TRANSFER SYSTEM FOR ELECTROPHOTOGRAPHIC PRINTING

[75] Inventor: Venkat K. Iyer, Webster, N.Y.

[73] Assignee: Xerox Corporation, Stamford, Conn.

[22] Filed: May 14, 1975

[21] Appl. No.: 577,375

[52] U.S. Cl. ..... 355/3 R; 96/1.4

[51] Int. Cl.[2] ..... G03G 15/16

[58] Field of Search ..... 355/3 TR, 3 P, 3 TE, 355/3 R; 96/1.4, 1 TE; 118/637

[56] References Cited

UNITED STATES PATENTS

| | | | |
|---|---|---|---|
| 3,785,816 | 1/1974 | LaGagnina et al. | 355/3 P |
| 3,817,615 | 6/1974 | Adachi et al. | 355/3 TE |
| 3,838,918 | 10/1974 | Fisher et al. | 355/3 TR |
| 3,944,355 | 3/1976 | Matkan | 355/3 R |

*Primary Examiner*—L. T. Hix
*Assistant Examiner*—J. A. LaBarre
*Attorney, Agent, or Firm*—H. Fleischer; C. A. Green; J. J. Ralabate

[57] ABSTRACT

An apparatus in which charged particles are transferred from a support surface to a sheet of support material secured to a transfer member. The apparatus includes an electrically biased plate member positioned between the support surface and transfer member.

16 Claims, 4 Drawing Figures

TRANSFER SYSTEM FOR ELECTROPHOTOGRAPHIC PRINTING

BACKGROUND OF THE INVENTION

This invention relates generally to an electrophotographic printing machine, and more particularly concerns an improved transfer apparatus for utilization therein.

As described in U.S. Pat. No. 2,297,691 issued to Carlson in 1942, the process of electrophotographic printing requires that a photoconductive member be charged to a substantially uniform potential so as to sensitize the surface thereof. Thereafter, the charged photoconductive surface is exposed to a light image of an original document. Exposure of the charged photoconductive surface to the light image selectively dissipates the charge in the irradiated areas in accordance with the light intensity projected thereon. This records an electrostatic latent image on the photoconductive surface corresponding to the original document. Development of the electrostatic latent image recorded on the photoconductive surface is achieved by bringing a developer mix into contact therewith. A typical developer mix generally employs dyed or colored thermoplastic powders, known in the art as toner particles, which are mixed with coarser carrier granules, such as ferromagnetic granules. The toner particles of the developer mix are selected to have the appropriate charge relative to the electrostatic latent image recorded on the photoconductive surface. As the developer mix is brought into contact with the electrostatic latent image, the greater attractive force thereof moves the toner particles from the carrier granules to the latent image. Thereafter, the toner powder image is transferred from the electrostatic latent image to a sheet of support material, such as paper, or a thermoplastic sheet, amongst others. The toner powder image adhering to the sheet of support material is permanently affixed thereto by the application of heat.

Hereinbefore, the toner powder image has been transferred to the sheet of support by an electrical field created by a corona generator similar to that disclosed in U.S. Pat. No. 2,836,724 issued to Vyverberg in 1958. The corona generator induces transfer of the toner particles to the sheet of support material by spraying a corona discharge having a polarity opposite to that carried by the toner particles on the photoconductive surface onto the backside of the sheet of support material. This causes the toner particles to be electrostatically transferred to the sheet of support material.

Other techniques utilize electrically biased transfer rolls. The transfer roll generates a high voltage discharge in the proximity of the surface of the paper, or it may be applied by means of a conductive cylinder in contact with paper as disclosed in U.S. Pat. No. 2,807,233 issued to Fitch in 1957. As taught therein, a sheet of support material is interposed between the conductive roller and a surface having the toner powder image thereof. A charge of opposite polarity from that of the toner particles is deposited on the backside of the sheet of support material which attracts the toner powder image thereto.

Finally, U.S. Pat. No. 3,838,918 issued to Fisher et al. in 1974 describes a corona generator with pre-conditions the toner particles prior to their being transferred from the photoconductive surface to a sheet of support material by a transfer roll. The sheet of support material is secured to an electrically biased transfer roll. After being pre-conditioned by an alternating charge potential applied to the photoconductive surface by the corona generating device, the toner particles are transferred to the sheet of support material secured releasably on the electrically biased transfer roll.

Premature transfer of toner powder images from the photoconductive surface to the sheet of support material is minimized by the use of a control baffle. U.S. Pat. No. 3,850,519 issued to Weikel, Jr. describes a control baffle for directing the sheet of support material into contact with the photoconductive surface. The baffle is positioned adjacent to the photoconductive surface in close proximity therewith so that the sheet of support material is guided into tangential moving contact with the moving photoconductive surface prior to the sheet entering the corona stream.

U.S. Pat. No. 3,620,617 describes a corona generator having a mesh sheet interposed between the corona generating device and the sheet of support material adjacent the photoconductive member.

Another patent of interest is U.S. Pat. No. 3,785,816. This patent describes an apparatus for eliminating corona arcing between the electrodes in an electrophoretic imaging system. Baffles are positioned at the exit and entrance of the nip between adjacent electrodes at the point of image transfer. This eliminates premature arcing breakdown.

Many factors influence the quality of the transferred powder image, the most significant factors being those which effect the uniformity with which the toner powder image is transferred from the photoconductive surface to the sheet of support material. Hereinbefore, the process of transferring successive layers of toner to a common sheet of support material, as exemplified by multi-color electrophotographic printing, has posed numerous problems. In particular, when a bias transfer roll is utilized to transfer successive toner powder images, in superimposed registration, to a sheet of support material, hollow characters frequently occur. Hollow characters may be defined as a toner area wherein substantially only the periphery thereof is transferred while the central portion remains devoid of toner particles. The problem of hollow characters is most pronounced for line copy reproductions. However, hollow characters frequently occur in solid area copy as well. It has been found that without the use of a corona generating device in conjunction with a bias transfer roll, approximately sixty to seventy percent of the image is devoid of toner particles, i.e. the hollow character is of a significant magnitude. Contrawise, with the introduction of the corona generating device, the devoid area was reduced to approximately twenty to thirty percent. However, this level has proven to be unsatisfactory when high quality reproductions are desired.

Accordingly, it is the primary object of the present invention to improve the apparatus for transferring a toner powder image from a photoconductive surface to a sheet of support material.

BRIEF SUMMARY OF THE INVENTION

Briefly stated, and in accordance with the present invention, there is provided an apparatus for transferring charged particles from a support surface to a sheet of support material.

Pursuant to the features of the present invention, the apparatus includes a transfer member and a plate member. The sheet of support material is secured to the transfer member. An electrical bias is applied to the transfer member. The transfer member is positioned closely adjacent to the support surface with the electrical bias being of sufficient magnitude and polarity to attract the charged particles from the support surface to the sheet of support material thereon. The plate member is positioned between the support surface and the transfer member. An electrical bias having a potential substantially equal to the magnitude of the potential biasing the transfer member is applied to the surface of the plate member opposed from the transfer member.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
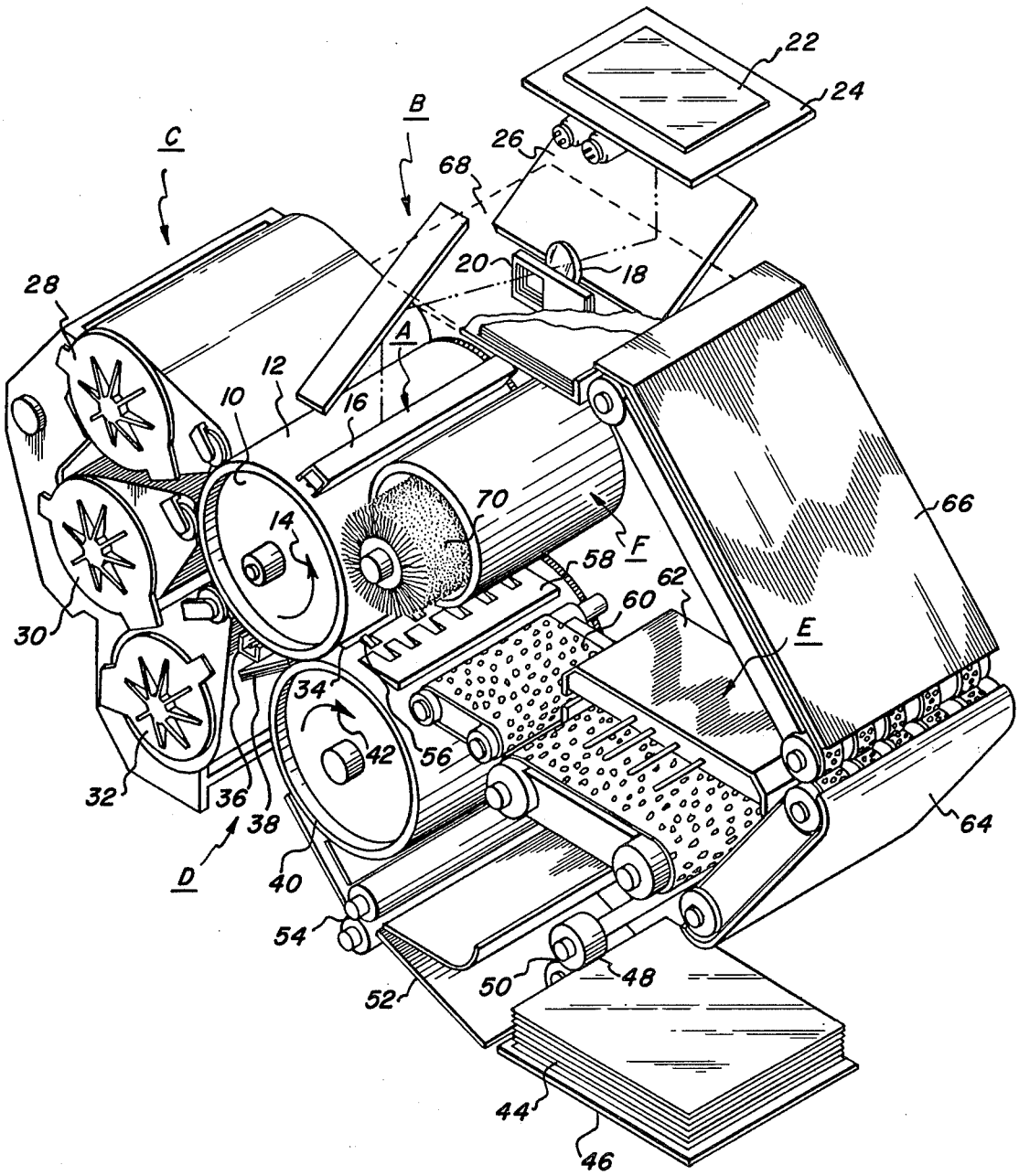
FIG. 1 is a schematic perspective view of an electrophotographic printing machine incorporating the features of the present invention therein.

For a general understanding of the disclosed electrophotographic printing machine in which the present invention may be incorporated, continued references is had to the drawings. Like reference numerals have been used throughout the drawings to designate like elements. FIG. 1 schematically illustrates the various components of a printing machine incorporating the features of the present invention therein. Although the transfer apparatus of the present invention is particularly well adapted for use in such an electrophotographic printing machine, it should become evident from the following discussion that it is equally well suited for use in a wide variety of electrostatographic printing machines and is not necessarily limited in its application to the particular embodiment shown herein.

The art of electrophotographic printing is well known. As such, the various processing stations employed in the printing machine of FIG. 1 will be described only briefly.

As shown in FIG. 1, the electrophotographic printing machine employs a photoconductive member having a drum 10 with a photoconductive surface 12 secured thereto and entrained about the circumferential surface thereof. One type of suitable photoconductive material is a polychromatic selenium alloy as described in U.S. Pat. No. 3,655,377 issued to Sechak in 1972. A series of processing stations are located such that as drum 10 rotates in the direction of arrow 14 it passes sequentially therethrough. Drum 10 is driven at a predetermined speed by a drive motor (not shown) relative to the various machine operating mechanisms. A timing disc, mounted on the end of the drum shaft, rotates in synchronism with drum 10. The timing disc has a plurality of slits in the periphery thereof arranged to transmit light rays from a light source therethrough to a photosensor. The photosensor produces a series of pulses indicative of the position of drum 10. These electrical pulses are processed by the machine logic to coordinate the sequence of operations at each processing station.

Initially, drum 10 moves photoconductive surface 12 to charging station A. At charging station A, a corona generating device, indicated generally at 16, charges photoconductive surface 12 to a relatively high substantially uniform potential. Corona generating device 16 extends in a generally transverse direction longitudinally across photoconductive surface 12. In this manner, corona generating device 16 produces a spray of ions for the charging of a portion of photoconductive surface 12. A suitable corona generating device is described in U.S. Pat. No. 3,875,407 issued to Hayne in 1975.

Thereafter, drum 10 rotates the charged portion of photoconductive surface 12 to exposure station B. At exposure station B, a color filtered light image of the original document is projected onto the charged portion of photoconductive surface 12. Exposure station B includes a moving lens system, generally designated by the reference numeral 18, and a color filter mechanism shown at 20. A suitable drive system for lens system 18 is disclosed in U.S. Pat. No. 3,062,108 issued to Mayo in 1962. U.S. Pat. No. 3,592,531 issued to McCrobie in 1970 describes a suitable lens. Color filter mechanism 20 is described in U.S. Pat. No. 3,775,006 issued to Hartman et al. in 1973. As shown in FIG. 1, an original document 22, such as a sheet of paper, book, or the like, is placed face down upon transparent viewing platen 24. Lamp assembly 26, filter mechanism 20 and lens 18 move in a timed relationship with drum 10 to scan successive incremental areas of original document 22. In this manner, a flowing light image of original document 22 is projected onto the charged portion of photoconductive surface 12. Filter mechanism 20 interposes a selected color filter into the optical light path. The selected color filter operates on the light rays passing through lens 18 to record an electrostatic latent image on photoconductive surface 12 corresponding to a preselected spectral region of the electromagnetic wave spectrum, hereinafter referred to as a single color electrostatic latent image.

After exposure, drum 10 rotates the single color electrostatic latent image recorded on photoconductive surface 12 to development station C. Development station C includes three individual developer units, generally indicated by the reference numerals 28, 30 and 32, respectively. A suitable development station employing a plurality of developer units is disclosed in U.S. Pat. No. 3,854,449 issued to Davidson in 1974. These developer units are all of a type generally referred to as magnetic brush developer units. In a typical magnetic brush developer unit, a magnetizable developer mix of carrier granules and toner particles is continually brought through a directional flux field. This forms a brush of developer mix. The single color electrostatic latent image recorded on photoconductive surface 12 is developed by bringing the brush of developer mix into contact therewith. Each of the respective developer units contain discretely colored toner particles corresponding to the complement of the spectral region of the wave length of light transmitted through filter 20, i.e. a green filtered electrostatic latent image is rendered visible by depositing green absorbing magenta toner particles thereon. Blue and red latent images are developed with yellow and cyan toner particles, respectively.

Drum 10 next rotates the toner powder image deposited on photoconductive surface 12 to transfer station D. At transfer station D, the toner powder image adhering electrostatically to photoconductive surface 12 is transferred to a sheet of support material. Support material 34 may be plain paper or a sheet of thermoplastic material, amongst others. Transfer station D includes corona generating means, indicated generally by the reference numeral 36, a plate member, shown generally by numeral 38, and a transfer member, depicted generally by the reference numeral 40. U.S. Pat. No. 3,838,918 issued to Fisher et al. in 1974, the relevant portions thereof being hereby incorporated into the present application, discloses the use of a corona generating device and a transfer member to effect transfer of the toner powder image from the photoconductive surface to the sheet of support material. Inasmuch as these elements are described in the foregoing patent, the present application will only briefly discuss their operation. Corona generator 36 is excited with an alternating current for spraying ions onto photoconductive surface 12 so as to pre-condition the toner powder image adhering electrostatically thereto. This facilitates the transfer of the toner powder image from the electrostatic latent image recorded on photoconductive surface 12 to support material 34. Transfer member 40 is a roll adapted to recirculate support material 34 in synchronism with the movement of drum 10. An electrical bias having a potential of sufficient magnitude and polarity to attract electrostatically the pre-conditioned toner particles from the latent image is applied to transfer roll 40. Successive toner powder images are transferred to the sheet of support material secured releasably on transfer roll 40. Transfer roll 40 rotates in the direction of arrow 42 at substantially the same angular velocity as drum 10. Plate member 38 is positioned between transfer roll 40 and drum 10. This plate is positioned prior to the nip defined by drum 10 and transfer roll 40 after corona generator 36 in the direction of rotation of drum 10, as indicated by arrow 14. Preferably, plate 38 is located about 0.250 inches from this nip. However, this may range from about 0.250 inches to about 0.400 inches. The surface of plate member 38 opposed from transfer roll 40 may be electrically biased to a potential having a magnitude substantially equal to the magnitude of the potential electrically biasing transfer roll 40. By electrically biasing this surface to a potential substantially equal to the potential biasing transfer roll 40, the process current can be reduced by preventing charge transfer between transfer roll 40 and plate 38 due to air breakdown. The surface of plate member 38 opposed from drum 10 is electrically grounded. However, it may also be electrically biased to a few hundred volts, i.e. from about 100 to about 300 volts. Plate member 38 has a thickness ranging from about 3 to 5 mils and extending in a lengthwise direction a distance substantially equal to the length of transfer roll 40. Preferably, plate member 38 is a multi-layered structure. Plate member 38 includes a pair of conductive layers having an insulating layer interposed therebetween. The detailed structural arrangement of corona generator 36, plate member 38, and transfer roll 40 will be discussed hereinafter with reference to FIGS. 2 through 4, inclusive.

Continuing now with the operation of the electrophotographic printing machine described in FIG. 1, the sheet feeding path will be briefly described hereinafter. Support material 34 is advanced from a stack 44 mounted on tray 46. Feed roll 48, in operative communication with retard roll 50, advances and separates the uppermost sheet from stack 44 disposed on tray 46. The advancing sheet moves into chute 52 which directs it into the nip between register rolls 54. Register rolls 54 align and forward the advancing sheet to gripper fingers 56 mounted on transfer roll 40. Gripper fingers 56 secure support material 34 releasably on transfer roll 40 for movement in a recirculating path therewith. After a plurality of toner powder images have been transferred to support material 34, gripper fingers 56 space support material 34 from transfer roll 40. As transfer roll 40 continues to rotate in the direction of arrow 42, stripper bar 58 is interposed therebetween. Support material 34 moves over stripper bar 58 onto endless belt conveyor 60. Endless belt conveyor 60 advances support material 34 to fixing station E.

At fixing station E, a fuser, indicated generally by the reference numeral 62, applies sufficient heat to permanently affix the transferred toner powder images to support material 34. One type of suitable fuser is described in U.S. Pat. No. 3,781,516 issued to Tsilibes et. al. in 1973. After the fusing process, support material 34 is advanced by endless belt conveyors 64 and 66 to catch tray 68 for subsequent removal therefrom by the machine operator.

Invariably, residual toner particles remain on photoconductive surface 12 after the transfer of the powder image therefrom. These residual toner particles are removed from photoconductive surface 12 as it passes through cleaning station F. At cleaning station F, the residual toner particles are initially brought under the influence of a cleaning corona generating device (not shown) for neutralizing the electrostatic charge thereon and the charge remaining on photoconductive surface 12. Fibrous brush 70 contacting photoconductive surface 12 then removes the neutralized toner particles therefrom. A suitable brush cleaning device is described in U.S. Pat. No. 3,590,412 issued to Gerbasi in 1971.

It is believed that the foregoing description is sufficient for purposes of the present application to depict the general operation of an electrophotographic printing machine embodying the teachings of the present invention therein.

Figure 2:
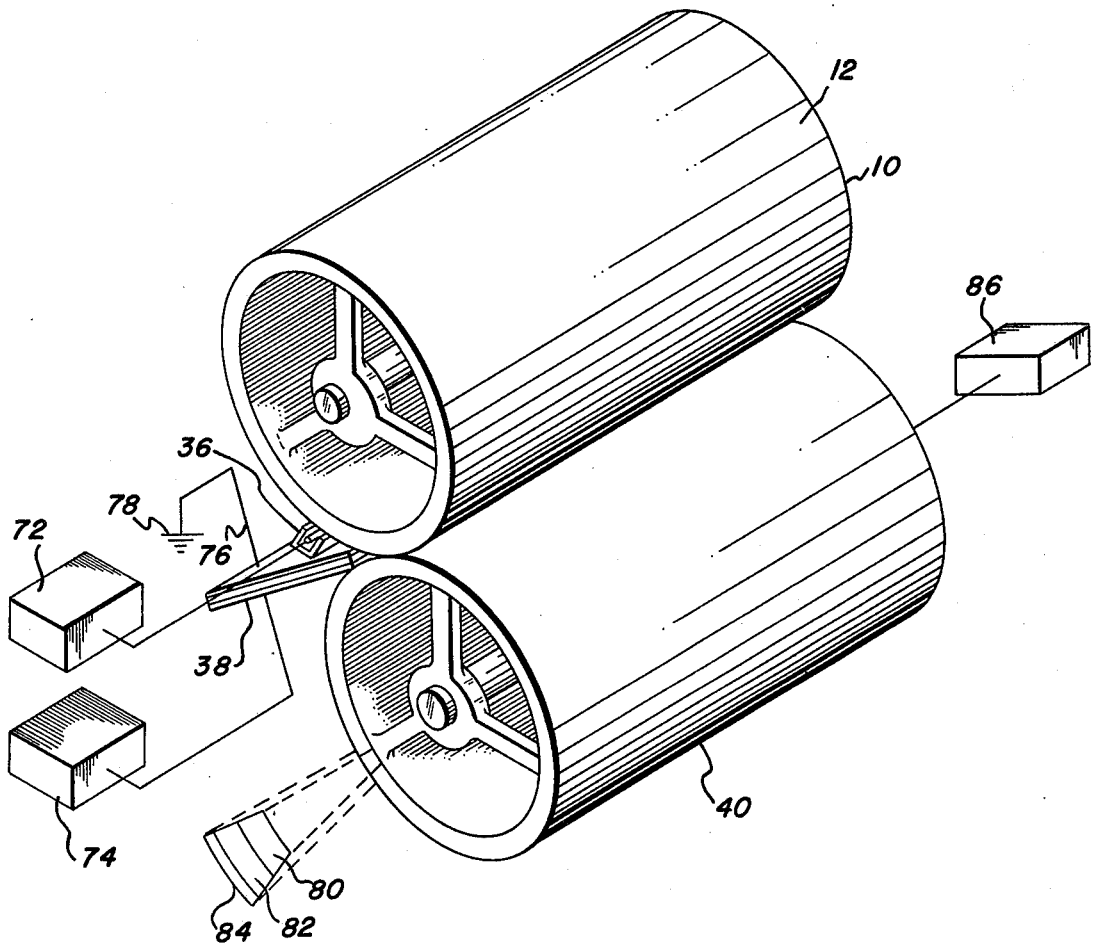
FIG. 2 is a schematic perspective view of a transfer apparatus employed in the FIG. 1 printing machine.

Referring now to the specific subject matter of the present invention, FIG. 2 depicts the transfer apparatus associated with photoconductive surface 12 of drum 10. As shown in FIG. 2, voltage source or power supply 72 energizes the discharge electrode of corona generating means 36. Preferably, the discharge electrode of corona generating means 36 is excited at about 110 micro-amperes and about 4400 volts rms, the range being from about 80 micro-amperes at about 3000 volts rms to about 200 micro-amperes at about 5000 volts rms. The alternating current output from the discharge electrode to photoconductive surface 12, with the toner powder image thereon, ranges from about 3.0 to 5.0 micro-amperes, and is preferably about 4.0 micro-amperes. In this way, corona generator 36 sprays ions onto the toner powder image adhering electrostatically to photoconductive surface 12, thereby pre-conditioning the toner powder image to facilitate the transfer therefrom. Corona generator 36 will be described hereinafter in greater detail with reference to FIG. 4.

Plate member 38 is positioned after corona generator 36 prior to the nip defined by drum 10 and transfer roll 40. Voltage source or power supply 74 electrically biases the surface of plate member 38 opposed from transfer roll 40 to a potential having a magnitude substantially equal to the magnitude of the potential electrically biasing transfer roll 40. The surface of plate member 38 opposed from drum 10 is electrically grounded by wire 76 extending to a ground point 78 on the machine frame. The surface of plate member 38 opposed from drum 10 may be electrically biased in lieu of being grounded. In this mode of operation, the surface opposed from drum 10 is electrically biased to a few hundred volts, i.e. from about 100 to about 300 volts. An insulating layer is interposed between the opposed conducting layer. The insulating layer is of sufficient dielectric breakdown strength to prevent conduction between the separated conductive layers. Under suitable conditions, plate member 38 may only comprise two layers, a conducting layer opposed from transfer roll 40 and an insulating layer opposed from drum 10. However, for purposes of generality the tri-layered construction will be discussed hereinafter in greater detail with reference to FIG. 3.

With continued reference to FIG. 2, transfer roll 40 includes an aluminum tube 80, preferably, having about a ¼ inch thick layer of urethane 82 cast thereabout. A polyurethane coating 84, preferably of about 1 mil thick, is sprayed over the layer of cast urethane 82. Preferably, transfer roll 40 has a durometer hardness ranging from about 10 units to about 30 units on the Shore A scale. The resistivity of transfer roll 40, preferably, ranges from about $10^8$ to about $10^{11}$ ohm centimeters. A direct current bias voltage is applied to aluminum tube 80 via a carbon brush and brass ring assembly (not shown). Voltage source or power supply 86 is electrically connected to this carbon brush and brass ring assembly for applying the appropriate voltage to aluminum tube 80. Power supply 86 applies a transfer roll voltage which may range from about 1500 to about 4500 volts. Transfer roll 40 is substantially about the same diameter as drum 10 and is driven at substantially the same speed. Contact between photoconductive surface 12 of drum 10 and transfer roll 40, with support material 34 interposed therebetween, is, preferably limited to a maximum of about 2.0 lbs.

Figure 3:
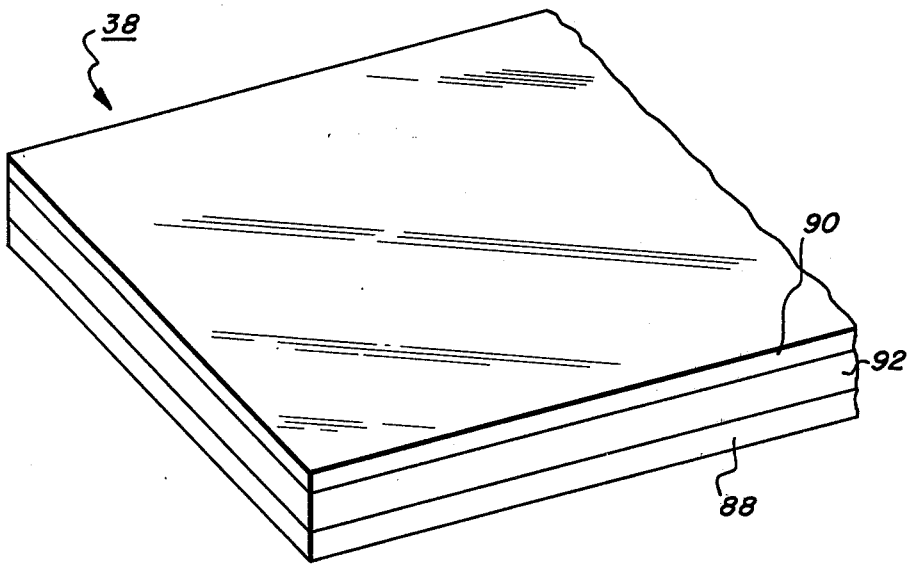
FIG. 3 is a fragmentary perspective view of a plate member utilized in the FIG. 2 transfer apparatus.

Referring now to FIG. 3, plate member 38 is shown therein in detail. As heretofore indicated, plate member is positioned between drum 10 and transfer roll 40 in the pre-nip zone to suppress pre-nip printout. Preferably, layer 88 of plate member 38 is conductive and opposed from transfer roll 40. Voltage source 74 (FIG. 2) electrically biases conductive layer 88 to a potential having a magnitude substantially equal to the magnitude of the potential electrically biasing transfer roll 40. Conductive layer 90 of plate member 38 is opposed from drum 10. Wire 76 (FIG. 2) electrically connects layer 90 to ground point 78 (FIG. 2) on the printing machine so as to electrically ground this layer. Interposed between and contacting layers 88 and 90 is insulating layer 92. Preferably, insulating layer 92 has a dielectric breakdown strength equal to or greater than 20 volts/micron. Conductive layers 90 and 88 are less than 1 mil each in thickness, while insulating layer 92 is about 5 mils in thickness. By way of example, conductive layers 90 and 92 may be formed from a suitable metallic material such as copper, aluminum, etc. Similarly, insulating layer 92 may be formed from a suitable humidity insensitive insulating material. All of these layers are integral with one another forming a thin multi-layered structure. The positioning of plate member 38 between drum 10 and transfer roll 40 permits higher electrical biasing to be applied to transfer roll 40. Thus, transfer roll 40 may be biased as high as 900 volts above the conventional pre-nip breakdown limit when plate member 38 is disposed therein. This improves transfer and reduces hollow characters, as well as permitting operation with a wider resistivity latitude for transfer roll 40.

Figure 4:
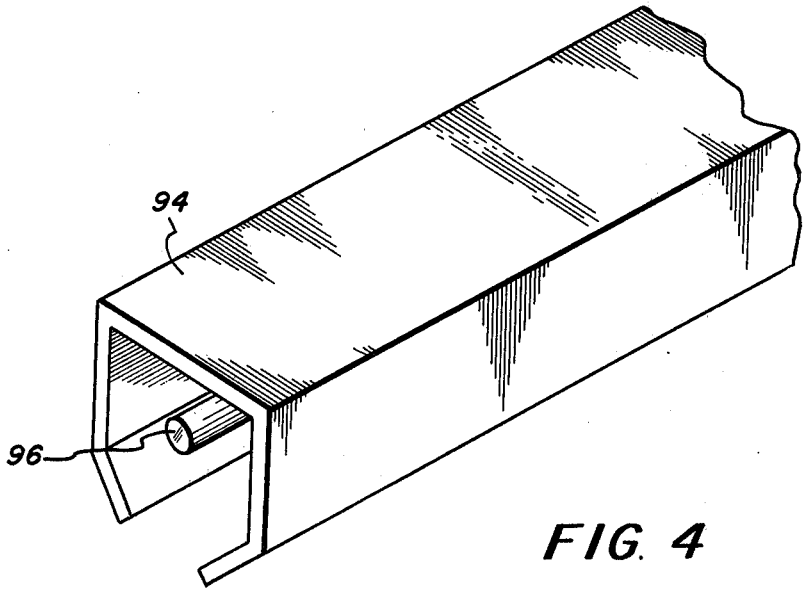
FIG. 4 is a fragmentary perspective view of a corona generator used in the FIG. 2 transfer apparatus.

Turning now to FIG. 4, corona generator 36 is shown therein in detail. Corona generator 36 includes an elongated shield 94 preferably made from a conductive material such as an aluminum extrusion. Elongated shield 94 is substantially U-shaped and may be grounded or, in lieu thereof, biased to a suitable electrical voltage level. A discharge electrode 96 is mounted in the chamber defined by U-shaped shield 94. Discharge electrode 96 is, preferably, a coronode wire approximately 0.0035 inches in diameter and extending longitudinally along the length of shield 94. Coronode wire 96 is made preferably from platinum. Discharge electrode 96 is excited by power supply 72 (FIG. 2) to produce a flow of ions therefrom. The ion flow is adapted to pre-condition the toner particles deposited on the electrostatic latent image of photoconductive surface 12. In this way, the efficiency of attracting the toner powder image from the electrostatic latent image to the sheet of support material secured on transfer roll 40 is enhanced.

In recapitulation, it is apparent that a transfer roll cooperating with an alternating current corona generator and a plate member interposed therebetween substantially minimizes hollow characters and improves the transfer of the toner powder image from the photoconductive surface to the sheet of support material. This is particularly significant when a plurality of toner powder images are transferred from the photoconductive surface to the sheet of support material in superimposed registration with one another, as in the case of color electrophotographic printing.

It is, therefore, evident that there has been provided in accordance with the present invention an apparatus for transferring a toner powder image developed on a photoconductive surface to a sheet of support material that fully satisfies the objects, aims and advantages hereinbefore set forth. While this invention has been described in conjunction with specific embodiments thereof, it is evident that many alternatives, modifications and variations will be apparent to those skilled in the art. Accordingly, is is intended to embrace all alternatives, modifications and variations that fall within the spirit and broad scope of the appended claims.

What is claimed is:

1. An apparatus for transferring charged particles from a support surface to a sheet of support material, including:

a transfer member having the sheet of support material secured thereto, said transfer member being positioned closely adjacent to the support surface and being biased electrically to a potential of sufficient magnitude and polarity to attract the charged particles from the support surface to the sheet of support material; and a plate member positioned between the support surface and said transfer member, said plate member having the surface thereof opposed from said transfer member electrically biased to a potential substantially equal to the magnitude of the potential biasing said transfer member, said plate member comprising a first conductive layer opposed from said transfer member, a second conductive layer opposed from the support surface, an insulating layer interposed between and in contact with said first and second conductive layers, and means for electrically biasing said second conductive layer.

2. An apparatus as recited in claim 1, further including means for electrically biasing said first conductive layer.

3. An apparatus as recited in claim 1, further including means for applying an electrical biasing potential to said transfer member.

4. An apparatus as recited in claim 3, wherein said transfer member includes:

a cylindrical core of electrically conductive material;

a first layer of resilient material entrained about said cylindrical core and being in substantial contact therewith; and a second layer of resilient material entrained about said first layer of resilient material and being in substantial contact therewith.

5. An apparatus as recited in claim 1, further including corona generating means disposed adjacent the support surface and adapted to apply an alternating charge potential thereto, thereby pre-conditioning the charged particles on the support surface to readily facilitate the transfer therefrom to the sheet of support material secured to said transfer member.

6. An apparatus as recited in claim 5, wherein said corona generating means includes:

an elongated shield defining an open-ended chamber; and a corona discharge electrode mounted in the chamber of said shield for generating ions to charge the particles on the support surface.

7. An apparatus as recited in claim 6, further including means for energizing said discharge electrode.

8. An apparatus as recited in claim 7, wherein:

said shield includes a substantially U-shaped member; and said discharge electrode includes a conductive coronode wire mounted in the chamber of said shield and extending substantially in a longitudinal direction along the length of said shield.

9. An electrophotographic printing machine of the type wherein toner particles are transferred from a photoconductive member to a sheet of support material, including:

a transfer member having the sheet of support material secured thereto, said transfer member being positioned closely adjacent to the photoconductive member and being biased electrically to a potential of sufficient magnitude and polarity to attract the toner particles from the photoconductive member to the sheet of support material; and a plate member positioned between the photoconductive member and said transfer member, said plate member having the surface thereof opposed from said transfer member electrically biased to a potential substantially equal to the magnitude of the potential biasing said transfer member, said plate member comprising a first conductive layer opposed from said transfer member, a second conductive layer opposed from the photoconductive member, an insulating layer interposed between and in contact with said first and second conductive layers, and means for electrically biasing said second conductive layer.

10. A printing machine as recited in claim 9, further including means for electrically biasing said first conductive layer.

11. A printing machine as recited in claim 9, further including means for applying an electrical biasing potential to said transfer member.

12. A printing machine as recited in claim 11, wherein said transfer member includes:

a cylindrical core of electrically conductive materials;

a first layer of resilient material entrained about said cylindrical core and being in substantial contact therewith; and a second layer of resilient material entrained about said first layer of resilient material and being in substantial contact therewith.

13. A printing machine as recited in claim 9, further including corona generating means disposed adjacent the photoconductive member and adapted to apply an alternating charge potential thereto, thereby pre-conditioning the toner particles on the photoconductive member to readily facilitate the transfer therefrom to the sheet of support material secured to said transfer member.

14. A printing machine as recited in claim 13, wherein said corona generating means includes:

an elongated shield defining an open-ended chamber; and a corona discharge electrode mounted in the chamber of said shield generating ions to charge the toner particles on the photoconductive member.

15. A printing machine as recited in claim 14, further including means for energizing said discharge electrode.

16. A printing machine as recited in claim 15, wherein:

said shield includes a substantially U-shaped member; and said discharge electrode includes a conductive coronode wire mounted in the chamber of said shield and extending substantially in a longitudinal direction along the length of said shield.

* * * * *